US012612704B2

(12) United States Patent
Yang et al.

(10) Patent No.: US 12,612,704 B2
(45) Date of Patent: Apr. 28, 2026

(54) CATALYST WITH FUNCTIONALIZED SUPPORT

(71) Applicant: PLUG POWER INC., Latham, NY (US)

(72) Inventors: Fan Yang, Latham, NY (US); Qiang Sun, Latham, NY (US)

(73) Assignee: PLUG POWER INC., Latham, NY (US)

( * ) Notice: Subject to any disclaimer, the term of this patent is extended or adjusted under 35 U.S.C. 154(b) by 639 days.

(21) Appl. No.: 18/154,107

(22) Filed: Jan. 13, 2023

(65) Prior Publication Data

US 2024/0240334 A1 Jul. 18, 2024

(51) Int. Cl.

| | |
|---|---|
| ***C25B 11/067*** | (2021.01) |
| ***C25B 1/04*** | (2021.01) |
| ***C25B 9/19*** | (2021.01) |
| ***C25B 11/081*** | (2021.01) |
| ***C25B 13/04*** | (2021.01) |

(52) U.S. Cl.

CPC ..... *C25B 11/067* (2021.01); *C25B 1/04* (2013.01); *C25B 9/19* (2021.01); *C25B 11/081* (2021.01); *C25B 13/04* (2013.01)

(58) Field of Classification Search

None

See application file for complete search history.

(56) References Cited

U.S. PATENT DOCUMENTS

| | | | | |
|---|---|---|---|---|
| 8,895,207 | B2 * | 11/2014 | Artero | C25B 11/073 429/523 |
| 9,011,594 | B1 | 4/2015 | Kanungo et al. | |
| 11,124,885 | B2 | 9/2021 | Xu et al. | |
| 2014/0349203 | A1 | 11/2014 | Klose-Schubert et al. | |
| 2023/0411630 | A1 * | 12/2023 | Johnston | H01M 4/926 |

FOREIGN PATENT DOCUMENTS

| | | | |
|---|---|---|---|
| CA | 2543256 | C | 6/2010 |
| CA | 2857110 | A1 | 6/2013 |

OTHER PUBLICATIONS

International Search Report and Written Opinion in International Application No. PCT/US2024/011147, 11 pages. May 10, 2024.

Lv et al., "Activity of IrO2 Supported on Tantalum-Doped TiO2 Electrocatalyst for Solid Polymer Electrolyte Water Electrolyzer", RSC Advances, vol. 7, pp. 40427-40436. 2017.

Shamsi et al., "Novel Type of SO3H-Functionalized Nano-Titanium Dioxide as a Highly Efficient and Recyclable Heterogeneous Nanocatalyst for the Synthesis of Tetrahydrobenzo[b]pyrans" Applied Organometallic Chemistry, vol. 31, pp. 1-9. 2016.

(Continued)

*Primary Examiner* — Brian W Cohen

(74) *Attorney, Agent, or Firm* — Hesin Rothenberg Farley & Mesiti P.C.; Victor A. Cardona, Esq.; Christina E. Brule

(57) ABSTRACT

A catalyst includes a support and a plurality of catalyst particles disposed on the support. The support may include a plurality of metal oxide or doped metal oxide particles and a plurality of organic groups attached to the metal oxide or doped metal oxide particles via diazonium salt reaction. The plurality of organic groups, which may be aromatic groups and/or alkyl groups, may be substituted with functional groups that are positively or negatively charged.

12 Claims, 9 Drawing Sheets

(56) References Cited

OTHER PUBLICATIONS

Bui-Thi-Tuyet et al., "Modification of Fluorine-Doped Tin Oxide Surface: Optimization of the Electrochemical Grafting of Diazonium Salt", Surfaces and Interfaces, vol. 15, pp. 110-116. 2019.
Bagheri et al., "Titanium Dioxide as a Catalyst Support in Heterogeneous Catalysis", The Scientific World Journal, vol. 2014, 21 pages. Oct. 14, 2014.
Klose et al., "Membrane Interlayer with Pt Recombination Particles for Reduction of the Anodic Hydrogen Content in PEMWater Electrolysis", Journal of the Electrochemical Society, vol. 165 (16), pp. F1271-F1277. 2018.
Mousli et al., "Diazoniium-modified TiO2/polyaniline core/shell nanoparticles. Structural characterization, interfacial aspects and photocatalytic performances", Applied Surface Science, vol. 465, pp. 1078-1095. 2019.
Li et al., "Hierarchical polybenzimidazole-grafted graphene hybrids as supports for Pt nanoparticle catalysts with excellent PEMFC performance", Nano Energy, vol. 16, pp. 281-292. 2015.
Xin et al., "Polybenzimidazole (PBI) Functionalized Nanographene as Highly Stable Catalyst Support for Polymer Electrolyte Membrane Fuel Cells (PEMFCs)", Journal of the Electrochemical Society, vol. 163 (10), pp. F1228-F1236. 2016.
Xin et al., "Understanding Pt Nanoparticle Anchoring on Graphene Supports through Surface Functionalization", ACS Catal, vol. 6, pp. 2642-2653. 2016.
Yang et al., "Investigation of the Interaction between Nafion lIonomer and Surface Functionalized Carbon Black Using Both Ultrasmall Angle X-ray Scattering and Cryo-TEM", ACS Appl. Mater. Interfaces, vol. 9, pp. 6530-6538. 2017.

* cited by examiner

CATALYST WITH FUNCTIONALIZED SUPPORT

FIELD

The present disclosure relates generally to anode catalysts of the type that are suitable for use in an electrolyzer and relates more particularly to a novel such anode catalyst.

BACKGROUND

Standard water electrolysis generates hydrogen and oxygen gases by applying a direct current in order to dissociate the water reactant. Alkaline and proton exchange membrane (PEM) electrolyzers are two major types of electrolyzer used for water electrolysis. PEM electrolysis is a particularly attractive method due to the lack of corrosive electrolytes, a small footprint, and the requirement of only deionized water as a reactant. PEM electrolysis also produces very pure hydrogen without the typical catalyst poisons that may be found in hydrogen produced from reformation. Despite these advantages of PEM electrolysis, current hydrogen production from PEM electrolysis only comprises a small fraction of the global hydrogen market, primarily due to its high cost of expensive components (e.g., membranes, catalysts, and bipolar plates) and the electricity consumption.

One of the main obstacles in manufacturing an efficient PEM electrolyzer is the anode over-potential. The anode over-potential results from the poor oxygen evolution reaction (OER) kinetics. Ways to lower the over-potential at the anode are to utilize a better catalyst, increase the catalyst amount, or operate at higher temperature. Ir black and Ir oxide are used in PEM electrolyzers for oxygen evolution reaction (OER) catalysis on the anode side. Such catalysts are traditionally supportless and require over-loading due to agglomeration and nonuniform distribution of the catalyst.

SUMMARY

Certain shortcomings of the prior art are overcome, and additional advantages are provided herein through the provision of a novel catalyst including a functionalized support.

In an aspect, the present disclosure relates to a catalyst including a support, the support including at least one metal oxide and at least one organic group, and a plurality of Ir particles, the Ir particles having a positive or negative charge.

In an embodiment, the at least one organic group is attached to the at least one metal oxide via a diazonium salt reaction.

In another embodiment, the at least one metal oxide group is titanium oxide, zirconium oxide, niobium oxide, tantalum oxide, tin oxide, or any combination thereof. In yet another embodiment, the at least one metal oxide group further includes at least one dopant and the at least one dopant is tungsten, molybdenum, niobium, fluorine, or any combination thereof.

In a further embodiment, the at least one organic group is an optionally substituted aromatic group or an optionally substituted alkyl group. In another further embodiment, the optionally substituted aromatic group is phenyl substituted with a positively charged substituent. In still a further embodiment, the positively charged substituent is $NH_2$. In an embodiment, the optionally substituted aromatic group is phenyl substituted with a negatively charged substituent. In another embodiment, the negatively charged substituent is $SO_3H$, COOH, or OH.

In yet another embodiment, the plurality of Ir particles have a negative charge or a positive charge. In still another embodiment, each Ir particle is an $IrCl_6^{2-}$ particle. In a further embodiment, each Ir particle is an $Ir^+$ particle.

In another aspect, the present disclosure relates to a catalyst including: a support including a plurality of support particles, wherein each support particle has a surface and includes at least one metal oxide, at least one dopant attached to the at least metal oxide, and at least one organic group attached to the at least one metal oxide via a diazonium salt reaction; and a plurality of Ir particles, wherein the Ir particles have a positive or negative charge.

In an embodiment, the at least one metal oxide is titanium oxide, zirconium oxide, niobium oxide, tantalum oxide, tin oxide, or any combination thereof.

In another embodiment, the at least one dopant is tungsten, molybdenum, niobium, fluorine, or any combination thereof. In yet another embodiment, the at least one organic group is phenyl substituted with $NH_2$. In still another embodiment, each Ir particle of the plurality of Ir particles is an $IrCl_6^{2-}$ particle. In a further embodiment, the at least one organic group is phenyl substituted with $SO_3H$, COOH, or OH. In another further embodiment, each Ir particle of the plurality of Ir particles is an $Ir^+$ particle.

In yet another aspect, the present disclosure relates to a water electrolyzer cell including: a solid polymer proton exchange membrane, the solid polymer proton exchange membrane having first and second opposed faces; an anode catalyst layer, the anode catalyst layer being positioned along the first face of the solid polymer proton exchange membrane, said anode catalyst layer including a support including a plurality of support particles, wherein each support particle has a surface and includes at least one metal oxide, at least one dopant attached to the at least metal oxide, and at least one organic group attached to the at least one metal oxide via a diazonium salt reaction; and a plurality of Ir particle, wherein the Ir particles have a positive or negative charge; a cathode catalyst layer, the cathode catalyst layer being positioned along the second face of the solid polymer proton exchange membrane; a first current collector, the first current collector being positioned along the anode catalyst layer opposite the solid polymer exchange membrane; and a second current collector, the second current collector being positioned along the cathode catalyst layer opposite the solid polymer exchange membrane.

Additional features and advantages are realized through the techniques described herein. Other embodiments and aspects are described in detail herein and are considered a part of the claimed aspects.

BRIEF DESCRIPTION OF THE FIGURES

The accompanying drawings, which are hereby incorporated into and constitute a part of this specification, illustrate various embodiments of the disclosure and, together with the description, serve to explain the principles of the disclosure. In the drawings wherein like reference numerals represent like parts:

FIG. 6A is a typical hydrodynamic voltammogram obtained for the indicated sample on the tip of a rotating disk electrode (RDE) and subjected to a voltage scan and FIG. 6B is the cyclic voltammetry of the indicated sample.

DETAILED DESCRIPTION

Figure 1A:
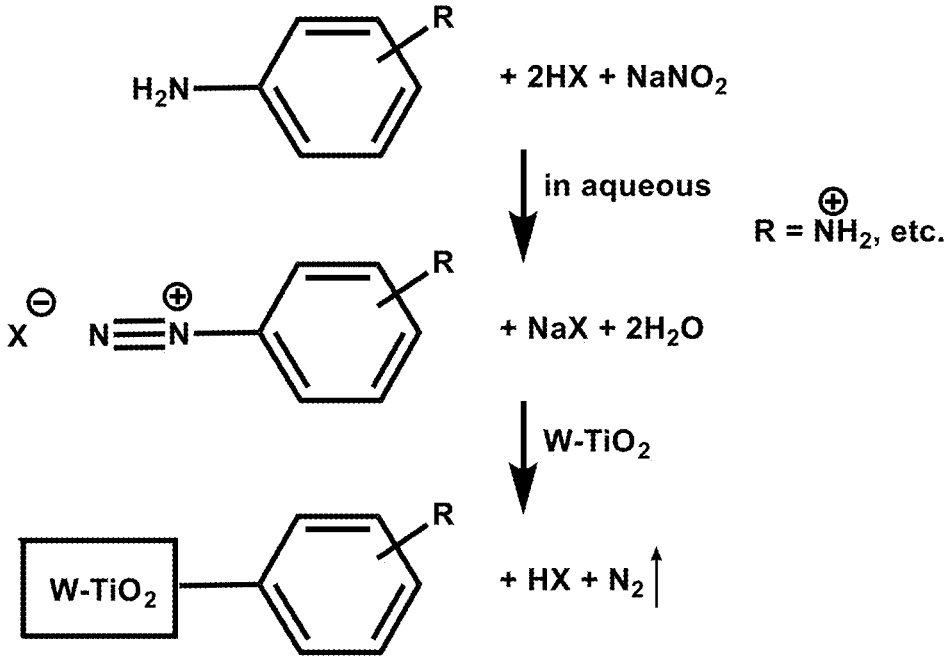
FIGS. 1A and 1B depict a non-limiting example of a support with positive charged functional groups (FIG. 1A) and negative charged Ir source (FIG. 1B)

The present disclosure is based, at least in part, on the discovery of a novel catalyst. The novel catalyst is particularly well-suited for use in, but is not limited to use in, electrolyzers, such as, but not limited to, PEM-based water electrolyzers. The novel catalyst overcomes the disadvantages of traditional supportless Ir black and Ir oxide oxygen evolution reaction (OER) catalysts and achieves higher activity Traditional carbon-based materials cannot be used on the anode of an electrolyzer because the carbon-based material could be oxidized very easily. The particular combination of Ir particles and tungsten-doped titanium oxide, as disclosed herein, is unique. The use of Ir particles as described herein results in better performance compared to other metals. Functional support will improve the distribution of the Ir nanoparticles. Unlike carbon supported catalyst, which is a continuous structure by itself and nanoparticles can be loaded on the structure without any functionalization (agglomeration happens a lot though), TiO2 itself is non-continuous nanoparticles, it would be very challenging to load Ir nanoparticles onto TiO2 without functionalization, only forming Ir clusters off the TiO2 support or very little on the support if any.

More specifically, according to one aspect of the disclosure, provided is a novel catalyst with a functionalized support for use in an electrolyzer. The catalyst includes a support with altered surface chemistry, wherein the support includes at least one metal oxide and at least one organic group, and a plurality of Ir particles, wherein the Ir particles have a positive or negative charge.

In an embodiment, the support may be in the form of one or more particles. The one or more particles may each have a diameter of from about 5 nanometers to about 100 microns, including all ranges and subranges therein, e.g., about 5 nanometers to about 500 nanometers, about 500 nanometers to about 10 microns, and about 10 microns to about 100 microns. The one or more support particles may each include a metal oxide or a doped metal oxide. Non-limiting examples of metal oxides include titanium oxide, zirconium oxide, niobium oxide, tantalum oxide, and tin oxide. Non-limiting examples of dopants include tungsten, molybdenum, niobium, antimony and fluorine. The amount of dopant in the doped metal oxide may be from about 0.1% to about 50% by weight, including all ranges and subranges therein, e.g., about 0.1% to about 1%, about 1% to about 10%, and about 10% to about 50%.

In an example, the doped metal oxide may be tungsten-titanium oxide, tungsten-zirconium oxide, tungsten-niobium oxide, tungsten-tantalum oxide, tungsten-tin oxide, molybdenum-titanium oxide, molybdenum-zirconium oxide, molybdenum-niobium oxide, molybdenum-tantalum oxide, molybdenum-tin oxide, niobium-titanium oxide, niobium-zirconium oxide, niobium-niobium oxide, niobium-tantalum oxide, niobium-tin oxide, fluorine-titanium oxide, fluorine-zirconium oxide, fluorine-niobium oxide, fluorine-tantalum oxide, or fluorine-tin oxide. In an example, the doped metal oxide is tungsten-titanium dioxide.

In an embodiment, the one or more support particles may each include an organic group, which may be attached to the metal oxide or doped metal oxide by a diazonium salt reaction. A diazonium reaction is a chemical process to transform aromatic primary amine into diazonium salt by reacting with sodium nitrite in a strongly acidic environment. In a first step, sodium nitrite reacts with strong acid and forms the nitrosonium ion; then the nitrosonium ion chemically reacts with the aromatic ring with $NH_2$, forming nitrogen-nitrogen bond and nitrosamine with the subsequent deprotonation; and then nitrosamine can be transformed into diazonium or salt with subsequent protonation and deprotonation. Diazonium salts with different functional groups may bind to the surface of different types of nanoparticles. Non-limiting examples of nanoparticles to which diazonium salts may bind to the surface include carbon black, Si, Pd, Ti, and the like.

The synthesis temperature is important as it affects the size of the nanoparticles and the chemical species of the nanoparticles. For example, temperature affects whether the Ir metal is $IrO_x$ or $Ir(OH)_x$. The temperature during synthesis may be from about 130 to about 200° C., including all ranges and subranges therein, e.g., about 130 to about 150, about 150 to about 180, and about 180 to about 200° C. If the temperature is too high, then the Ir nanoparticles may aggregate. If the temperature is too low, then the reaction may not go to completion. The functionalized support and unique temperature-species relationship of the Ir nanoparticles provides an overall increase in performance of the catalyst as described herein.

Figure 1B:
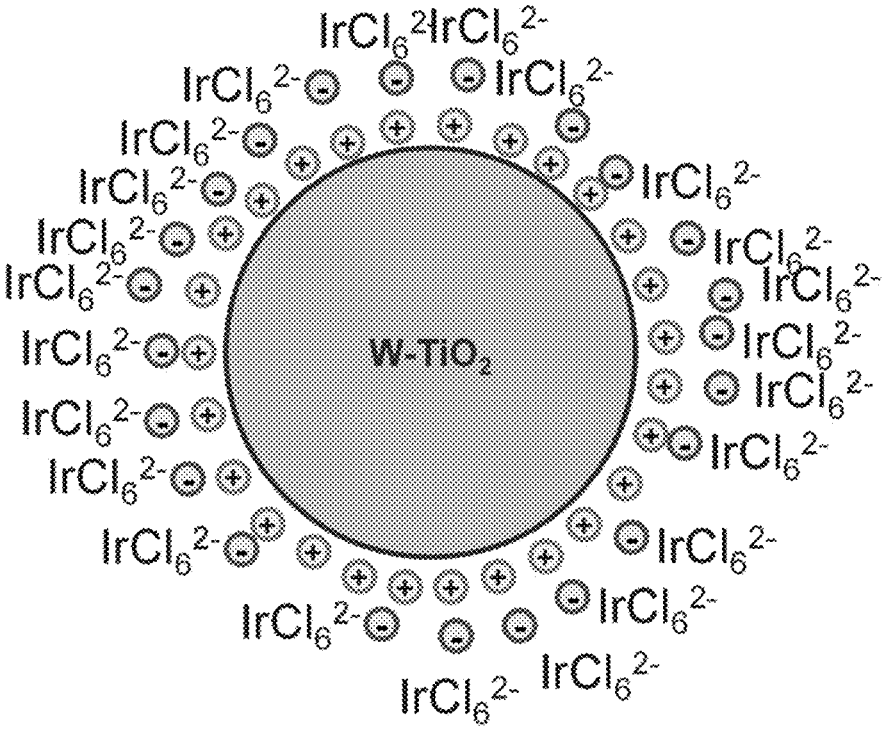

FIG. 1A is an example scheme of a procedure for a diazonium reaction to covalently functionalize the surface of the doped metal oxide to introduce a positive charge. The organic group, which in this non-limiting example is phenyl substituted with a positively charged substituent group, e.g., $NH_2$, $R^1$—NH, or $(R^1)_2$—N, wherein R, in each instance, is independently selected from the group consisting of hydrogen or optionally substituted hydrocarbon, is attached to the doped metal oxide. FIG. 1B is an example of negatively charged Ir particles, which in this non-limiting example are $IrCl_6^{2-}$, uniformly deposited on the functionalized doped metal-oxide support.

Figure 2A:
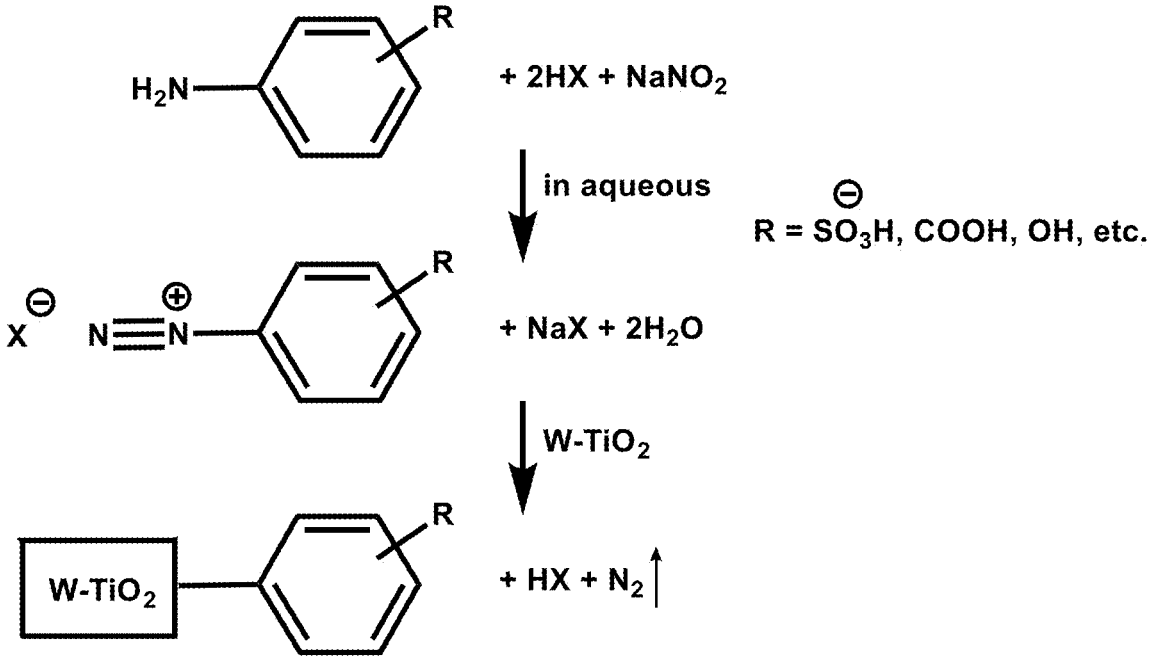
FIGS. 2A and 2B depict a non-limiting example of a support with negative charged functional groups (FIG. 2A) and positive charged Ir source (FIG. 2B)
Figure 2B:
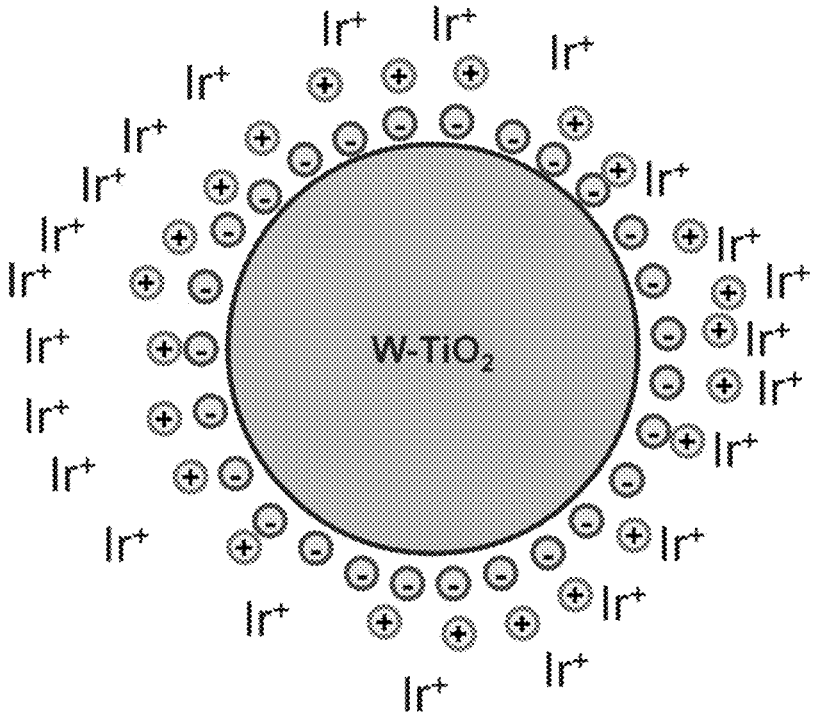

FIG. 2A is an example scheme of a procedure for a diazonium reaction to covalently functionalize the surface of the doped metal oxide to introduce a negative charge. The organic group, which in this non-limiting example is phenyl substituted with a negatively charged substituent group, e.g., $SO_3H$, COOH, or OH, is attached to the doped metal oxide. FIG. 2B is an example of positively charged Ir particles, which in this non-limiting example are $Ir^+$, uniformly deposited on the functionalized doped metal-oxide support.

Figure 4A:
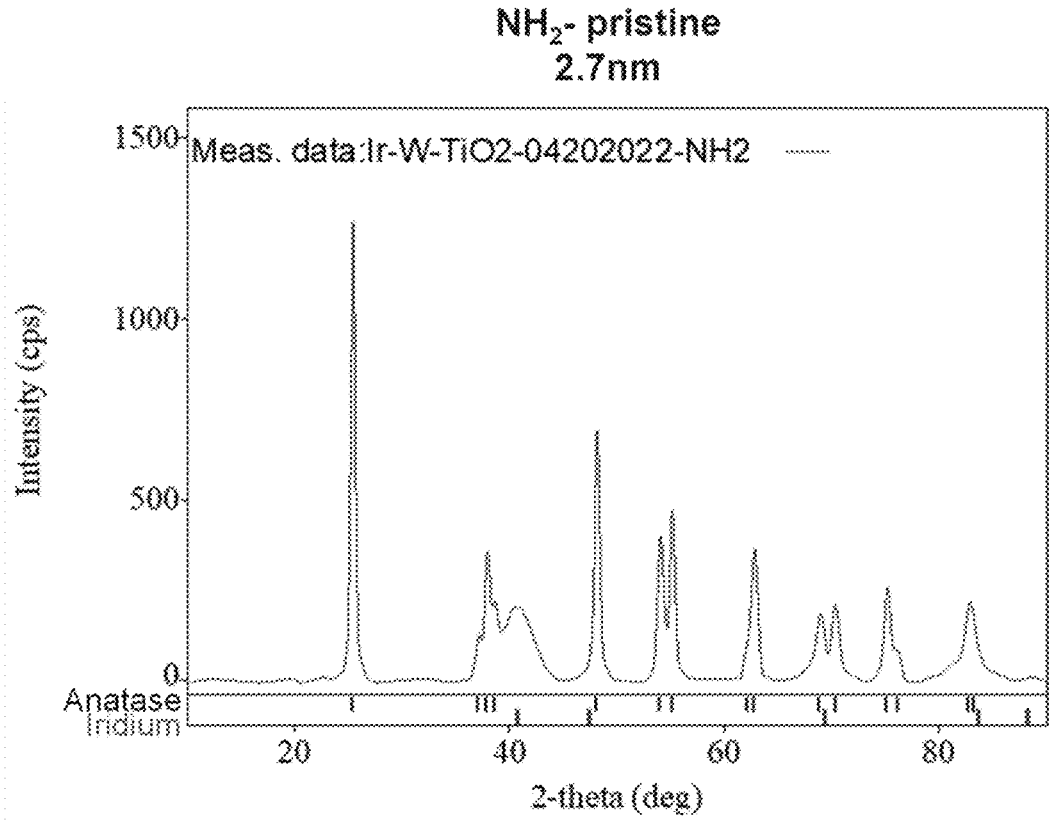
FIGS. 4A and 4B are x-ray diffraction (XRD) graphs of intensity (cps) vs. 2-theta (deg) of a support surface functionalized with $NH_2$ groups before (FIG. 4A) and after sintering (FIG. 4B)
Figure 4B:
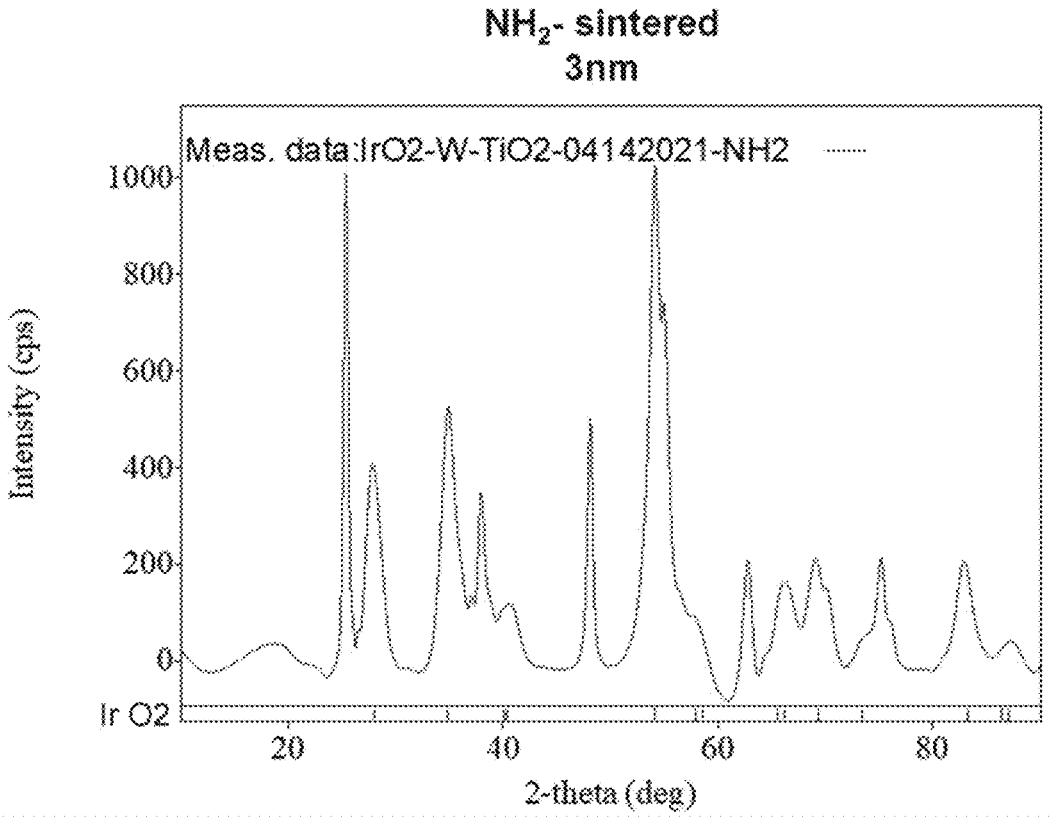
Figure 5A:
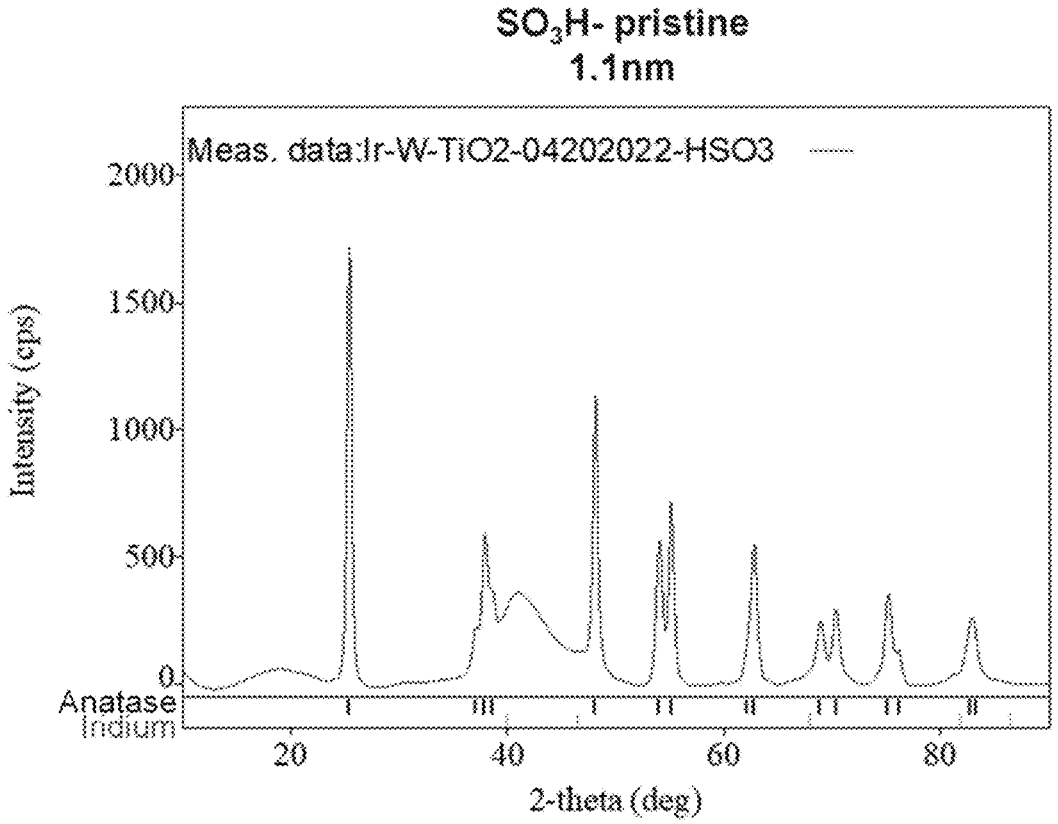
FIGS. 5A and 5B are x-ray diffraction (XRD) graphs of intensity (cps) vs. 2-theta (deg) of a support surface functionalized with $SO_3H$ groups before (FIG. 5A) and after sintering (FIG. 5B)
Figure 5B:
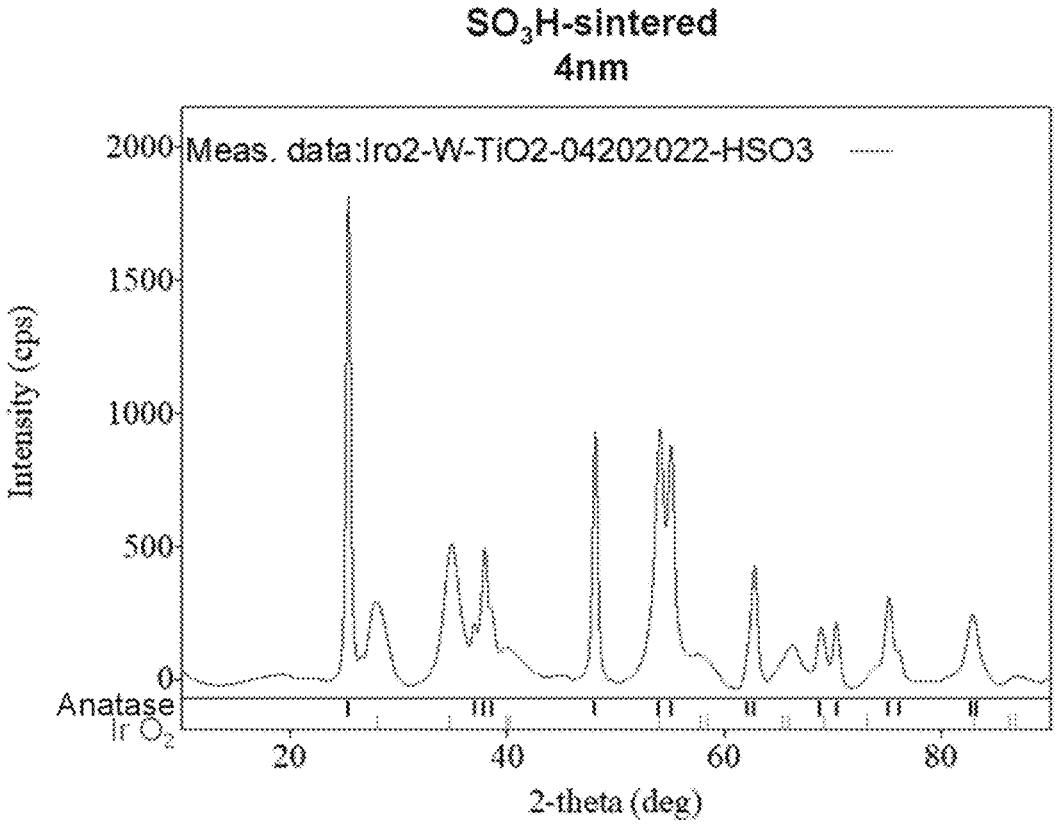

In an embodiment, the organic group may be an optionally substituted aromatic group or an optionally substituted alkyl group. The organic group facilitates homogeneous distribution of nanoparticles on the surface of the support and reduces the Ir average particle size. FIGS. 4A and 4B depict x-ray diffraction data of tungsten-doped titanium oxide grafted with $NH_2$, showing that the crystal size is small, i.e., approximately 2.7 nm, which is good for activity. Similarly, FIGS. 5A and 5B depict x-ray diffraction data of tungsten-doped titanium oxide grated with $SO_3H$ and having a crystal size of approximately 1.1 nm.

The term "aromatic" is intended to include any compound containing a planar unsaturated ring of atoms that is stabilized by an interaction of the bonds forming the ring. A non-limiting example of an aromatic group includes phenyl.

The term "alkyl" is intended to include linear or branched saturated hydrocarbon structures and combinations thereof. Non-limiting examples of an alkyl include methyl, ethyl, propyl, isopropyl, n-butyl, s-butyl, t-butyl, and the like.

The term "hydrocarbon" is intended to mean any group comprised of hydrogen and carbon as the only elemental constituents. If not otherwise limited, hydrocarbon is intended to include alkyl, cycloalkyl, polycycloalkyl, alkenyl, alkynyl, aryl, and combinations thereof. Non-limiting examples of a hydrocarbon include cyclopropylmethyl, benzyl, phenethyl, cyclohexylmethyl, adamantyl, camphoryl, and naphthylethyl. Aliphatic hydrocarbons are hydrocarbons that are not aromatic; they may be saturated or unsaturated, cyclic, linear, or branched. Examples of aliphatic hydrocarbons include isopropyl, 2-butenyl, 2-butynyl, cyclopentyl, norbornyl, etc. Aromatic hydrocarbons include benzene (phenyl), naphthalene (naphthyl), anthracene, etc.

The term "optionally substituted" maybe used interchangeably with "unsubstituted or substituted." The term "substituted may refer to the replacement of one or more hydrogen atoms in a specified group with a specified radical. In a non-limiting example, "optionally substituted aromatic group" may refer to an unsubstituted or substituted aromatic group, and "substituted aromatic group" may refer to an aromatic group wherein one or more hydrogen atoms in each residue is replaced with $NH_2$, $R^1$—NH, $(R^1)_2$—N, $SO_3H$, COOH, or OH, wherein R, in each instance, is independently selected from the group consisting of hydrogen or optionally substituted hydrocarbon.

In an example, the organic group may be substituted with $NH_2$, $R^1$—NH, $(R^1)_2$—N, or any combination thereof. In another example, the organic group may be substituted with $SO_3H$, COOH, OH, or any combination thereof. In yet another example, the organic group may be an alkyl group substituted with $NH_2$, $R^1$—NH, $(R^1)_2$—N, or any combination thereof. In still another example, the organic group may be an alkyl group substituted with $SO_3H$, COOH, OH, or any combination thereof.

In an embodiment, the catalyst particles may be one or more members selected from the group consisting of iridium, iridium oxide, ruthenium, ruthenium oxide, platinum, platinum oxide, and platinum black particles. For example, in any embodiment providing a non-limiting example using iridium particles, the iridium particles may be substituted with iridium oxide particles, ruthenium particles, ruthenium oxide particles, platinum particles, platinum oxide particles, platinum black particles, or any combination thereof.

In an embodiment, when the organic group has a positive charge, the Ir particles have a negative charge. In a non-limiting example, the Ir particles may be $IrCl_6^{2-}$ or any salt in which the Ir particles carry a negative charge. In another embodiment, when the organic group has a negative charge, the Ir particles have a positive charge. In a non-limiting example, the Ir particles may be $Ir^+$ or any salt in which the Ir particles carry a positive charge. A non-limiting example of catalyst particles that may carry a positive charge is tetraamineplatinum hydroxide. The Ir particles may have a diameter of from about 1 nanometer to about 20 microns, including all ranges and subranges therein, e.g., about 1 nanometer to about 50 nanometers, about 50 nanometers to about 200 nanometers, and about 200 nanometers to about 20 microns.

The Ir particles may form one or more aggregations of at least 10 particles, wherein each particle is in physical contact with at least one other particle. The aggregation may be in the form of, for example, a branched or unbranched chain and/or a cluster. Ir particles may cover at least 20% of the circumference of the support particles. The support may have an open surface area (i.e., the surface of support not covered by aggregated Ir particles) in the range of about 20-80%, including all ranges and subranges therein, e.g., about 50-70%, 20-70%, and 50-80%.

The anode catalyst of the present disclosure may further include a binder in which a plurality of support particles, together with their associated catalyst particles, may be dispersed. Examples of the binder may include ionomers, such as Nafion®, Aquivion®, FumaPEM®, and sulfonated hydrocarbons.

In another aspect, the present disclosure relates to a water electrolyzer cell that includes a solid polymer proton exchange membrane (PEM), the solid polymer proton exchange membrane having first and second opposed faces; an anode catalyst layer, the anode catalyst layer being positioned along the first face of the solid polymer proton exchange membrane, said anode catalyst layer including a support including a plurality of support particles, wherein each support particle has a surface and includes at least one metal oxide, at least one dopant attached to the at least metal oxide, and at least one organic group attached to the at least one metal oxide via a diazonium salt reaction; and a plurality of Ir particle, wherein the Ir particles have a positive or negative charge; a cathode catalyst layer, the cathode catalyst layer being positioned along the second face of the solid polymer proton exchange membrane; a first current collector, the first current collector being positioned along the anode catalyst layer opposite the solid polymer exchange membrane; and a second current collector, the second current collector being positioned along the cathode catalyst layer opposite the solid polymer exchange membrane.

The water electrolyzer cell may include a PEM, an anode catalyse layer, a cathode catalyst layer, and current collectors. The PEM may be solid and provide ionic conductivity between the cathode and anode catalyst layers. Examples of materials suitable for use as PEM include, but are not limited to, Nafion®, Aquivion®, FumaPEM®, and sulfonated hydrocarbons.

The anode catalyst layer and cathode catalyst layer may be deposited on PEM by wet-casting, dry-casting, hot-pressing, or directly spraying the respective catalyst layers onto the PEM. The cathode catalyst layer may comprise standard cathode catalysts, such as platinum on carbon. The anode catalyst layer may comprise a plurality of support particles as described herein. Catalyst particles may be deposited on the support by electroless plating or any other method commonly known in the art. Support particles, together with their associated catalyst particles, may be dispersed in a binder, which may be, for example, an ionomer dispersion of the type described above. After the cathode and anode catalyst layers have been deposited on the PEM, the current collectors may be mechanically-secured against the cathode and anode catalyst layers on the sides opposite the PEM. The current collectors supply the voltage to the PEM-based water electrolyzer cell via an externally connected circuit wherein PEM-based water electrolyzer cell operates in the preferred range of 1.6V-2.0V.

The following examples are provided for illustrative purposes only and are in no way intended to limit the scope of the present disclosure:

EXAMPLE 1

Synthesis of Functionalized $W_xTi_{1-x}O_2$

To synthesize $NH_2$-functionalized $W_xTi_{1-x}O_2$ ($NH_2$—$W_xTi_{1-x}O_2$), 300 mg $W_xTi_{1-x}O_2$ was mixed into 300 mL aqueous solution with 83.7 mg p-phenylenediamine and 41.7 uL $H_2SO_4$. The mixture was dispersed via sonication for half an hour and then added with 52.8 mL $NaNO_2$ solution with a concentration of 1 mg $ml^{-1}$. The mixture was heated to 65° C. overnight. After that, the dispersion was washed by IPA/water with a ratio of 1:1 for three times, and the $NH_2$—$W_xTi_{1-x}O_2$ was separated by centrifuge with a rotation rate of 12,000 rpm for 20 mins. The final product was transferred to a vacuum oven at 80° C. and dried overnight.

To synthesize $HSO_3$-functionalized $W_xTi_{1-x}O_2$ ($SO_3H$—$W_xTi_{1-x}O_2$), 83.7 mg p-phenylenediamine was replaced by 132.6 mg sulfanilic acid.

Synthesis of Functionalized $W_xTi_{1-x}O_2$ Supported $IrO_2$ Via Polyol Reduction To synthesize $NH_2$-functionalized $W_xTi_{1-x}O_2$ supported Ir (Ir/$NH_2$—$W_xTi_{1-x}O_2$), 200 mg as-synthesized $NH_2$—$W_xTi_{1-x}O_2$ was dispersed into 60% EG solution and sonicated for 30 mins. Next, 12.3 mL 10 mg mL−1 $H_2IrCl_6$ was added to the mixture and heated up to 140° C. for 6 hours in the oil bath. After that, the mixed reactant was diluted with 1.5 L DI water and stirred overnight. The final product was separated by centrifuging at 14,000 rpm, washed with DI water three times, and vacuumed dry at 80° C. overnight. Ir/$HSO_3$—$W_xTi_{1-x}O_2$ was synthesized by replacing $NH_2$—$W_xTi_{1-x}O_2$ with $HSO_3$— $W_xTi_{1-x}O_2$ and replacing $H_2IrCl_6$ with $IrCl_3$ aqueous solution.

To transform Ir/functionalized-$W_xTi_{1-x}O_2$ to its corresponding functionalized-$W_xTi_{1-x}O_2$/$IrO_2$, 100 mg Ir/$W_xTi_{1-x}O_2$ was then heat-treated with a ramp rate of 3° C. min to 150° C. and held for 2 hours and 400° C. for another 2 hours with the same ramp rate. The final product was $IrO_2$/$NH_2$—$W_xTi_{1-x}O_2$-400 or $IrO_2$/$HSO_3$—$W_xTi_{1-x}O_2$-400.

Figure 3:
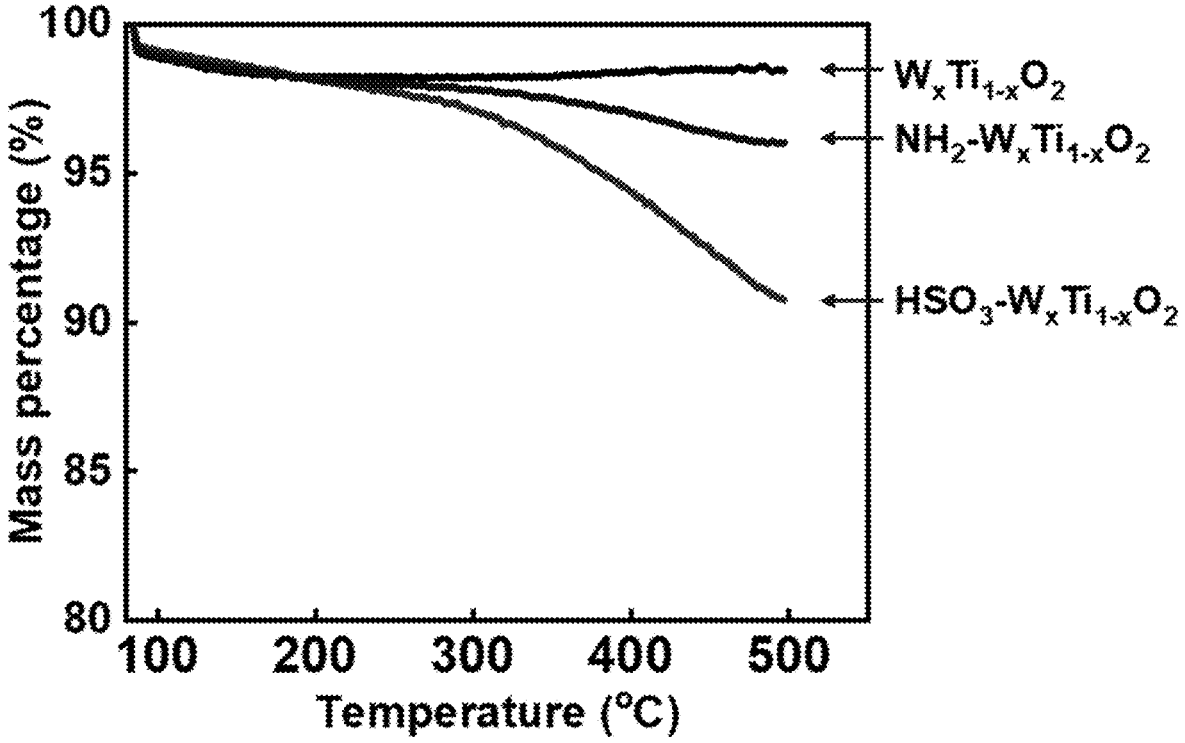
FIG. 3 is a TGA curve of thermogravimetric data confirming that the functional groups, $NH_2$ and $SO_3H$, were each grafted onto the support.

FIG. 3 confirms that the $NH_2$ and $SO_3H$ functional groups were grafted onto the tungsten-titanium oxide support particles.

Figure 6A:
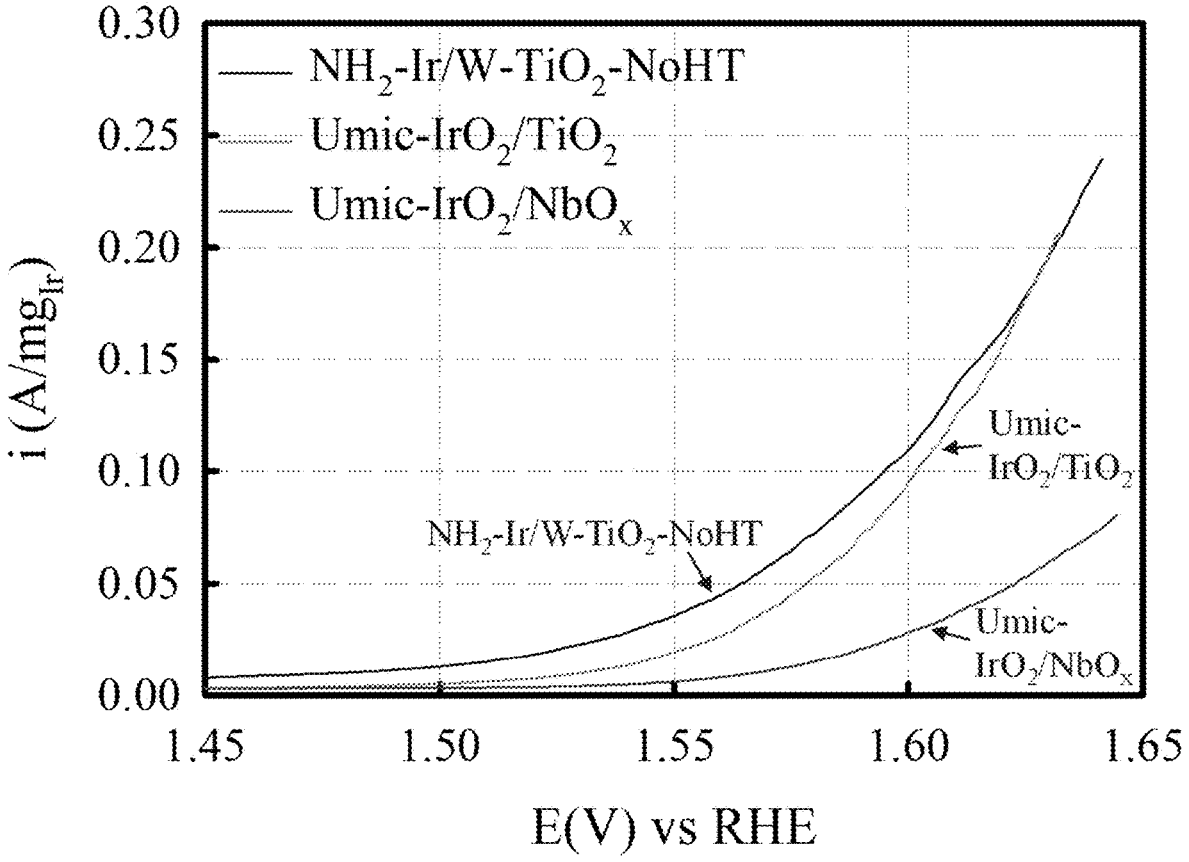
FIGS. 6A and 6B demonstrates activity of example functionalized supports vs. non-functionalized supports.

FIG. 6A demonstrates that modifying the surface of the support, e.g., tungsten-titanium oxide by grafting $NH_2$ onto the support via diazonium salt reaction, provides increased mass activity compared to commercial catalysts without a functionalized support, i.e., Umicore-$IrO_2$/$TiO_2$ and Umicore-$IrO_2$/$NbO_x$.

Figure 6B:
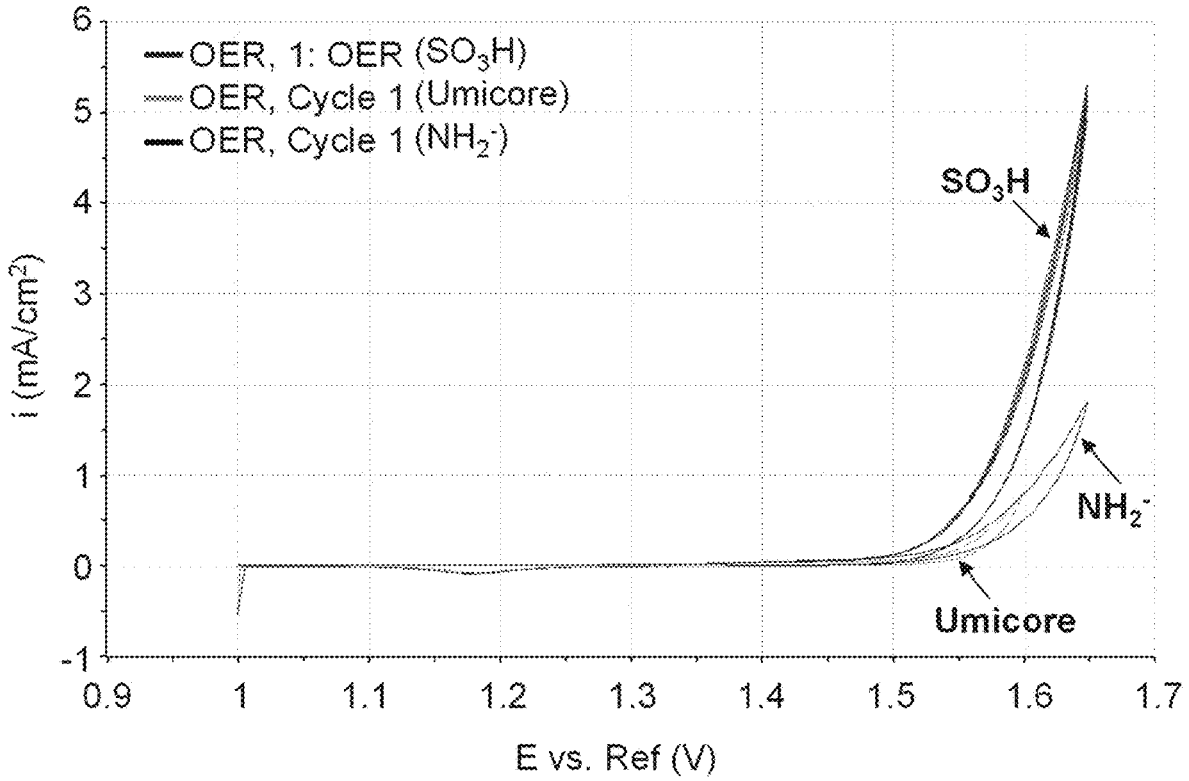

FIG. 6B demonstrates that grafting $SO_3H$ onto a surface-modified support, e.g., tungsten-titanium oxide, provides greater activity compared to the commercial Umicore catalyst.

The embodiments of the present disclosure described above are intended to be merely exemplary and those skilled in the art shall be able to make numerous variations and modifications to it without departing from the spirit of the present disclosure. All such variations and modifications are intended to be within the scope of the present disclosure as defined in the appended claims.

What is claimed is:

1. A catalyst comprising:

a support comprising a plurality of support particles, wherein each support particle has a surface and comprises at least one metal oxide, at least one dopant attached to the at least one metal oxide, and at least one organic group attached to the at least one metal oxide via a diazonium salt reaction; and a plurality of catalyst particles, wherein the catalyst particles are $IrCl_6^{2-}$ or $Ir^+$.

2. The catalyst of claim 1, wherein the at least one metal oxide is titanium oxide, zirconium oxide, niobium oxide, tantalum oxide, tin oxide, or any combination thereof.

3. The catalyst of claim 1, wherein the at least one organic group is phenyl substituted with $NH_2$.

4. The catalyst of claim 1, wherein the at least one organic group is phenyl substituted with $SO_3H$, COOH, or OH.

5. The catalyst of claim 1, wherein the plurality of catalyst particles further comprises one or more of iridium, iridium oxide, ruthenium, ruthenium oxide, platinum, platinum oxide, platinum black particles, or any combination thereof.

6. A water electrolyzer cell comprising:

a solid polymer proton exchange membrane, the solid polymer proton exchange membrane having first and second opposed faces;

an anode catalyst layer, the anode catalyst layer being positioned along the first face of the solid polymer proton exchange membrane, said anode catalyst layer comprising:

a support comprising a plurality of support particles, wherein each support particle has a surface and comprises at least one metal oxide, at least one dopant attached to the at least one metal oxide, and at least one organic group attached to the at least one metal oxide via a diazonium salt reaction; and a plurality of catalyst particles, wherein the catalyst particles are $IrCl_6^{2-}$ or $Ir^+$;

a cathode catalyst layer, the cathode catalyst layer being positioned along the second face of the solid polymer proton exchange membrane;

a first current collector, the first current collector being positioned along the anode catalyst layer opposite the solid polymer exchange membrane; and a second current collector, the second current collector being positioned along the cathode catalyst layer opposite the solid polymer exchange membrane.

7. The water electrolyzer cell of claim 6, wherein the at least one dopant is tungsten.

8. The water electrolyzer cell of claim 7, wherein the at least one metal oxide is titanium oxide.

9. The catalyst of claim 1, wherein the at least one dopant is tungsten.

10. The catalyst of claim 9, wherein the at least one metal oxide is titanium oxide.

11. The catalyst of claim 1, wherein the at least one dopant is tungsten, molybdenum, niobium, fluorine or any combination thereof.

12. The water electrolyzer cell of claim 6, wherein the at least one dopant is tungsten, molybdenum, niobium, fluorine or any combination thereof.

* * * * *